US007037133B2

(12) United States Patent
Matsuo

(10) Patent No.: US 7,037,133 B2
(45) Date of Patent: May 2, 2006

(54) CONNECTOR

(75) Inventor: Yoshiyuki Matsuo, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/046,982

(22) Filed: Jan. 31, 2005

(65) Prior Publication Data

US 2005/0181679 A1 Aug. 18, 2005

(30) Foreign Application Priority Data

Feb. 13, 2004 (JP) ..... 2004-037285

(51) Int. Cl.
*H01R 13/648* (2006.01)

(52) U.S. Cl. ..... 439/606; 439/527; 439/569

(58) Field of Classification Search ..... 439/135, 439/148, 278, 281, 282, 527 X, 569 X, 571, 439/572, 574, 606 I, 736
See application file for complete search history.

(56) References Cited

U.S. PATENT DOCUMENTS 5,611,695 A 3/1997 Bentley
5,741,147 A * 4/1998 Konoya et al. ..... 439/189
5,997,320 A 12/1999 DeMello
6,146,200 A * 11/2000 Ito et al. ..... 439/596
6,276,952 B1 * 8/2001 Ferranti et al. ..... 439/345
6,582,240 B1 * 6/2003 Suto ..... 439/79
6,855,006 B1 * 2/2005 Brooks et al. ..... 439/606

* cited by examiner

*Primary Examiner*—Thanh-Tam Le
(74) *Attorney, Agent, or Firm*—Gerald E. Hespos; Anthony J. Casella

(57) ABSTRACT

A connector has a flat wide housing (20) formed of synthetic resin and a plurality of female terminal fittings (41) are accommodated inside the housing (20). Each terminal fittings (41) includes a barrel (44) fixed to an end of an electric wire (70) and a box-shaped body (43) forward from the barrel (44) and configured for connection with a terminal fitting of a mating connector. A wall of the housing (20) surrounding the terminal fittings (41) is constructed of a thin part (22) forward from a midway position in a longitudinal direction of the housing (20) and of a thick part (23) thicker than the thin part (22) and rearward from the midway position. The body (43) of each of the female terminal fittings (41) is disposed partly in the thin part (22) and partly in the thick part (23).

9 Claims, 5 Drawing Sheets

CONNECTOR

BACKGROUND OF THE INVENTION

1. Field of the Invention

The present invention relates to a connector.

2. Description of the Related Art

U.S. Pat. No. 5,997,320 and FIG. 5 herein disclose a connector for use in a wire harness that will electrically connect the body of a vehicle to a trailer. As shown in FIG. 5, the connector has a wide flat housing 1 formed of synthetic resin. Terminal fittings 2, 3 arranged in a row inside the housing 1 in the widthwise direction of the housing 1. A step 4 projects from the outer surface of the housing 1. The housing 1 has a thin part forward of the step 4 and a thick part rearward from the step 4. Each terminal fitting 2, 3 has a box-shaped body 7 that can be connected with a mating terminal fitting. A barrel 8 is disposed rearward of the body 7 and is fixed to an end of an electric wire 9. Almost all of the body 7 is accommodated in the thin part 5 and almost all of the barrel 8 is accommodated in the thick part 6.

The thin part 5 of the housing 1 has a low rigidity. Additionally, the neck between the body 7 and the barrel 8 of each terminal fitting 2, 3 is easily deformable. Thus an excessive external force on the thin part 5 can deform the thin part 5 elastically about the step 4 in the widthwise direction of the housing 1. Consequently the body 7 of each of the terminal fittings 2, 3 may incline in the width direction of the housing 1, and the terminal fittings 2, 3 may be bent.

The invention has been completed in view of the above-described situation, and an object of the invention is to prevent a terminal fitting from being bent.

SUMMARY OF THE INVENTION

The invention relates to a connector with a wide flat housing formed of synthetic resin. Terminal fittings are accommodated in the housing in a longitudinal direction of the housing. Each terminal fitting has a barrel fixed to an end of an electric wire. A box-shaped body is disposed forward from the barrel and can be connected with a terminal fitting of a mating connector. The housing has a wall surrounding the terminal fittings. The wall has a thin cross-sectionally small part forward from a midway position in the longitudinal direction of the housing. The wall also has a thick cross-sectionally larger part that is thicker than the thin part. The thick part is disposed rearward from the midway position. The body of each terminal fitting extends across the boundary between the thin and thick parts, and hence is disposed partly in both the thin part and the thick part. The box-shaped body of each terminal fitting is stronger than the neck between the body and the barrel of the terminal fitting. Thus, the body of each terminal fitting helps to support the thin part of the housing, and the thin part of the housing is not likely to deform elastically even if an external force is applied to the thin part. Accordingly, the female terminal fitting is not likely to be bent.

The thin part can be covered with a cap for waterproofing the housing.

A bracket preferably is mounted on an outer surface of the thick part and sandwiches the thick part in a widthwise direction of the housing. The thick part preferably is thick enough to withstand the weight of the bracket mounted thereon. The housing preferably is mounted on an object through the bracket. In the conventional art (see FIG. 5), the part corresponding to the bracket is formed from a resin material integral with the housing. Thus it is necessary to perform molding twice to form the part corresponding to the bracket. On the other hand, the bracket and the housing are formed separately according to the subject invention. Therefore, only one molding operation is necessary and labor is reduced accordingly. Additionally, the assembly of the housing and the separate bracket is smaller than the molded connector of the prior art.

At least one rib preferably projects from the outer surface of the thick part and most preferably continues entirely around the outer periphery of the thick part. A groove preferably is formed on an inner surface of the bracket and is configured for engaging the rib. The engagement of the rib and the groove prevents longitudinal movement of housing relative to the bracket. The rib projecting from the outer surface of the thick part increases the strength of the housing.

DETAILED DESCRIPTION OF THE PREFERRED EMBODIMENTS

Figure 1:
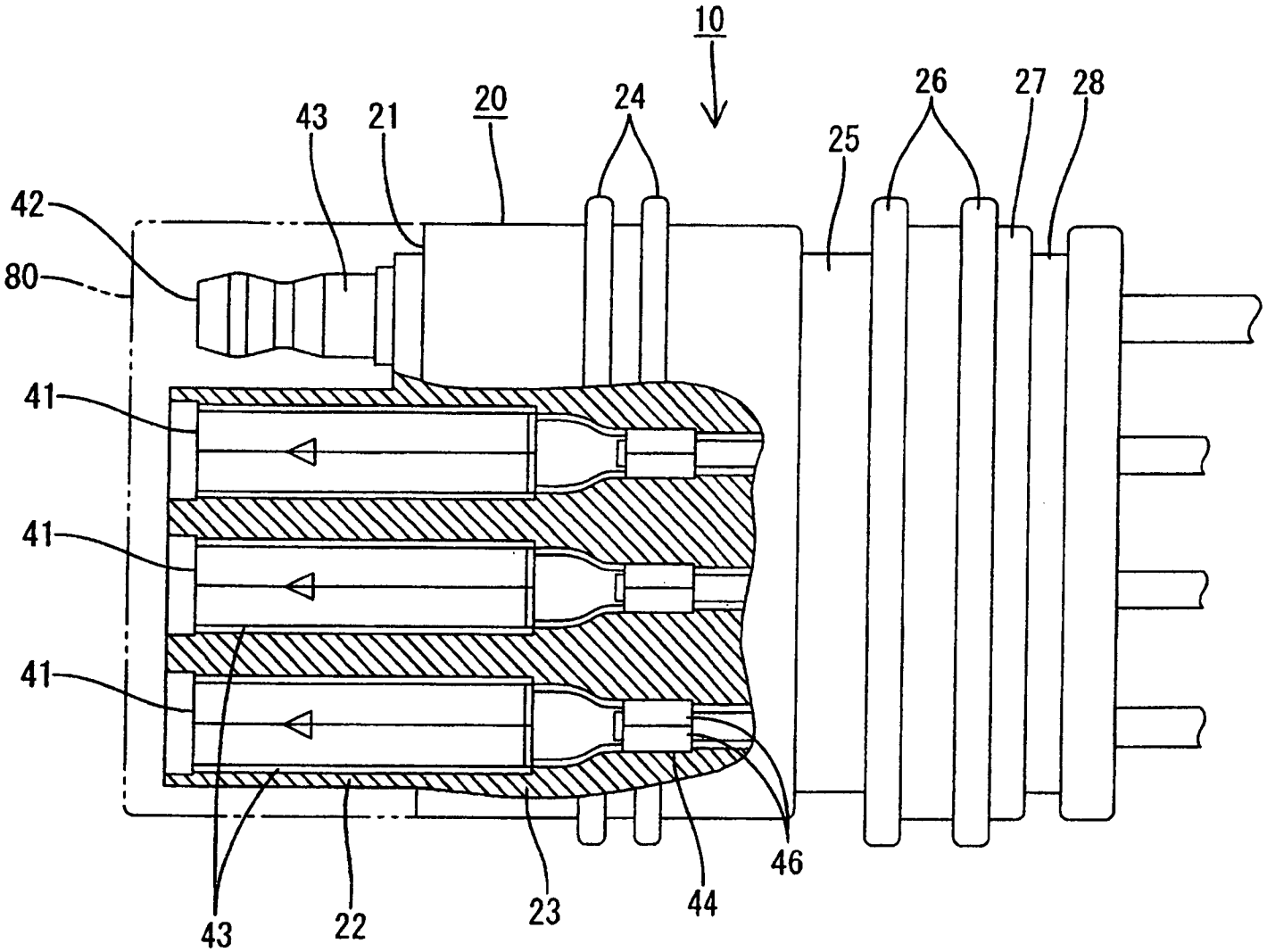
FIG. 1 is a plan view partly in section showing a connector of an embodiment of the present invention.

A connector according to the invention is identified by the numeral 10 in FIGS. 1 through 4. The connector 10 is for use in a wire harness for a vehicle, and enables electrical connection between a trailer and the vehicle. Additionally, the connector 10 is disposed on the body of the vehicle.

The connector 10 has a housing 20 that is molded unitarily from a synthetic resin to define a wide flat shape. The housing 20 accommodates a plurality of terminal fittings 41, 42 arranged widthwise in a row. The housing 20 has a step 21 formed midway on its outer surface in its longitudinal direction. A region forward from the step 21 is thinned to define a small cross-section. Thus a wall of the housing 20 surrounding the terminal fitting 40 has a thin cross-sectionally small part 22 forward of the step 21 and of a thick cross-sectionally larger part 23 rearward of the step 21. The thick part 23 is thicker and cross-sectionally larger than the thin part 22.

As shown in FIG. 1, the thin part 22 is covered with a rubber cap 80 before the connector 10 is fit on a mating connector. Although not shown in detail in FIG. 1, the cap 80 is tethered to the housing 20 through a string-shaped band (not shown in FIG. 1) made of flexible synthetic resin. The cap 80 has an open edge that abuts against the step 21 when the cap 80 is fit on the housing 20 to a predetermined depth to stop the cap 80 from moving forward. Thus, the cap 80 covers the entire thin part 22, and the outer surfaces of the cap 80 and the thick part 23 are almost flush with each other.

Two spaced-apart ribs 24 project from the outer surface of the thick part 23. The ribs 24 are approximately at the longitudinal center of the thick part 24 and extend continuously around the outer periphery of the thick part 23. The housing 20 has a medium part 25 rearward from the thick part 23. The medium part 25 is thinner than the thick part 23 and thicker than the thin part 22. Two spaced-apart ribs 26 project from the outer surface of a thickest part 27 disposed rearward of and adjacent to the medium part 25. Each rib 26 extends continuously around the outer periphery of the thickest part 27. The thickest part 27 has a thickness approximately equal to or slightly greater than the thickness of the thick part 23. The thickest part 27 has a concave peripheral groove 28 rearward of the ribs 26.

A bracket 60 is mounted on the outer surface of the thick part 23 of the housing 20 and sandwiches against the wider surfaces of thick part 23. The bracket 60 can be mounted on the body of the vehicle while holding the housing 20.

Figure 3:
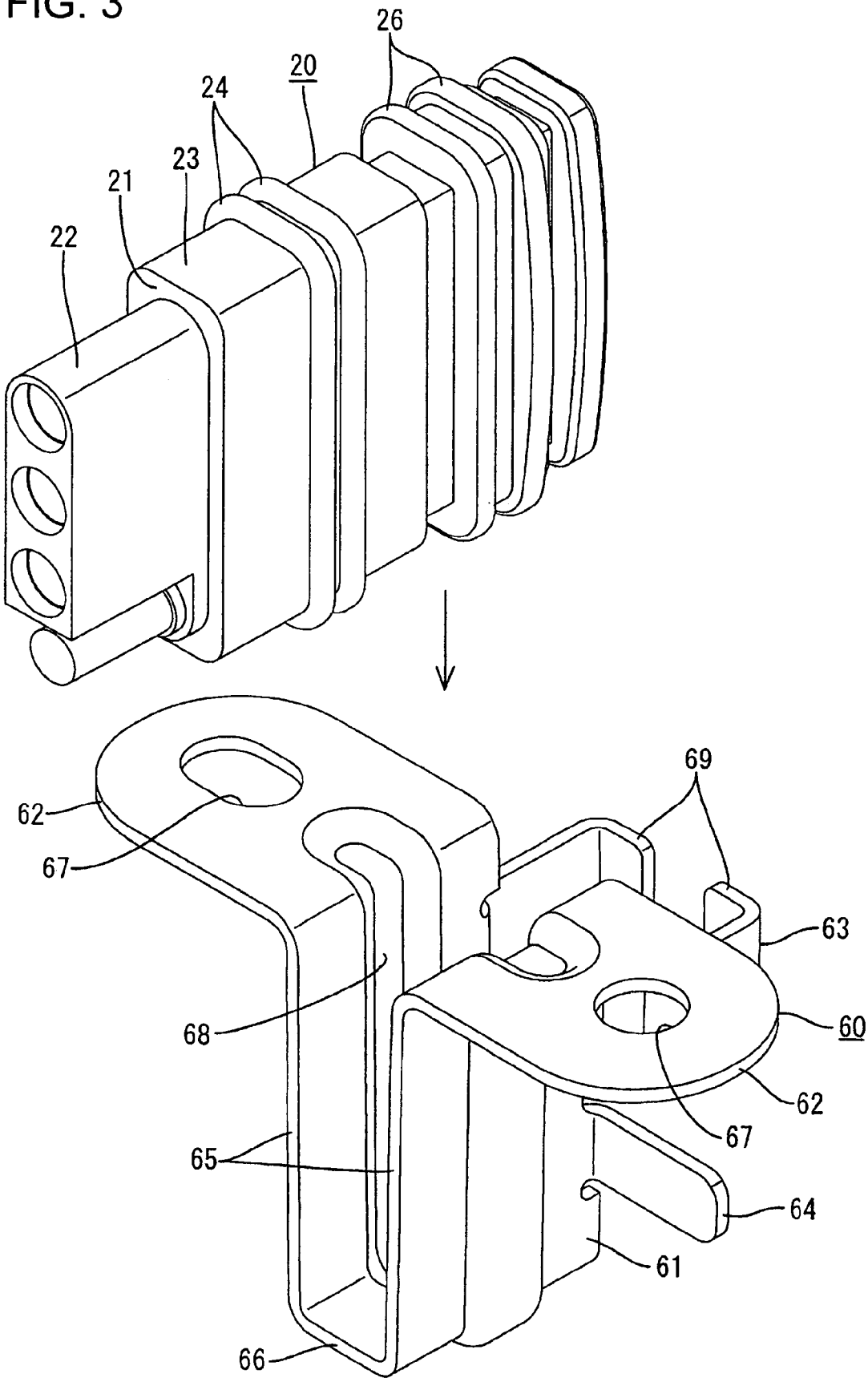
FIG. 3 is a perspective view showing a state before a housing is mounted on a bracket.
Figure 4:
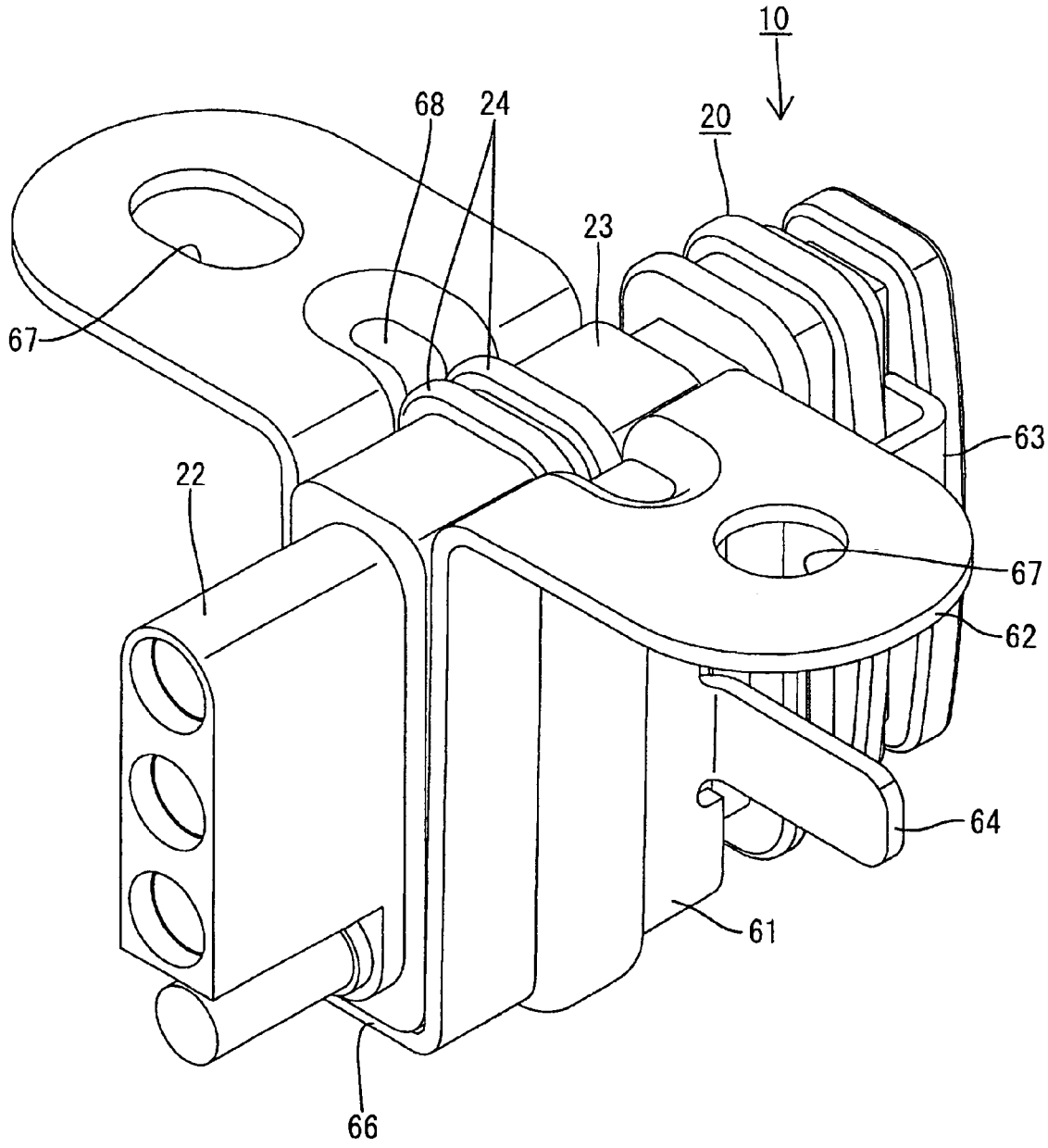
FIG. 4 is a perspective view showing a state after the housing is mounted on the bracket.
Figure 5:
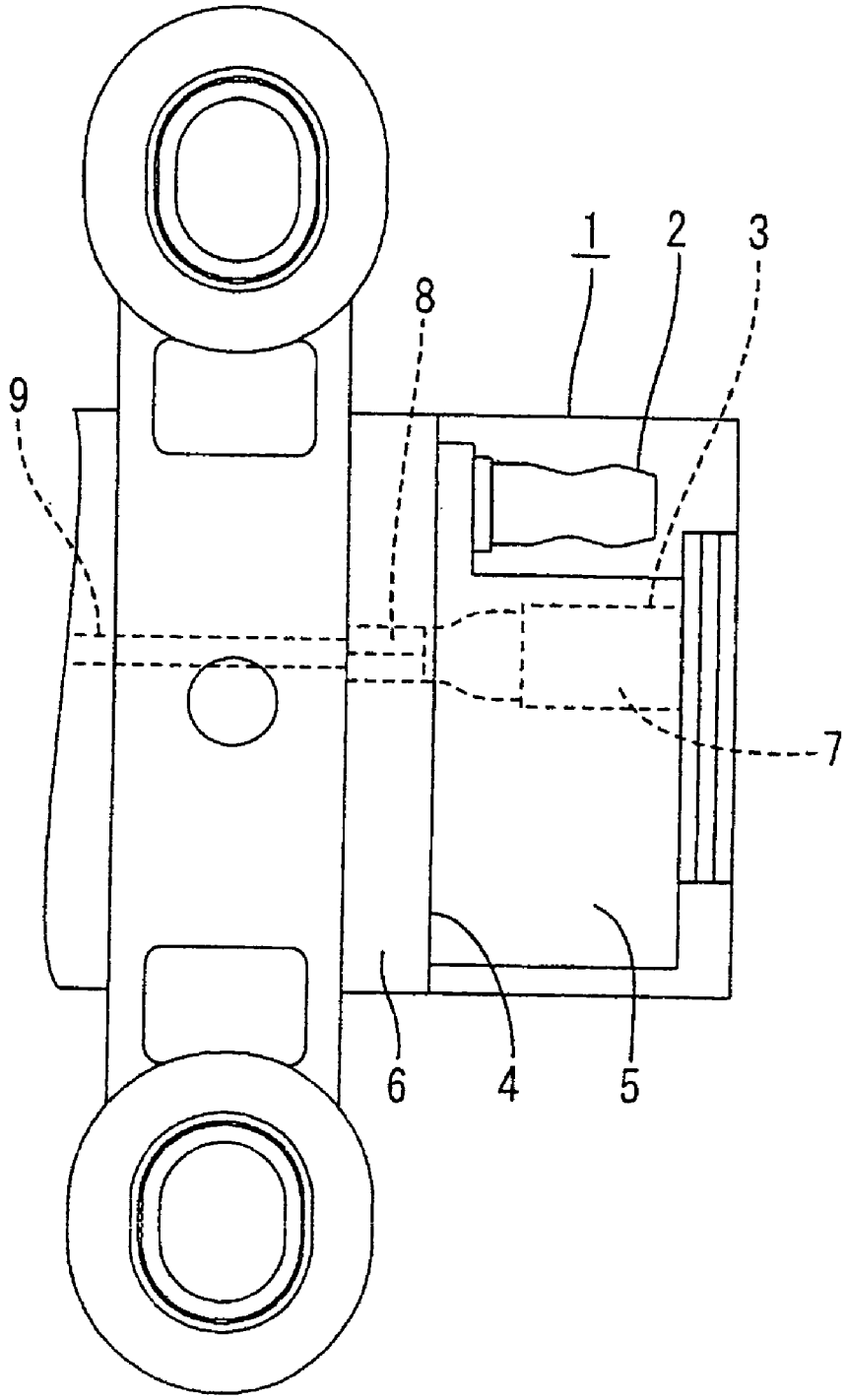
FIG. 5 PRIOR ART
FIG. 5 is a plan view showing a conventional connector.

The bracket 60 is formed by punching a metal plate into a predetermined configuration and then bending the punched metal plate into the shape shown in FIG. 3. The bracket 60 has a U-shaped holding part 61 and two mounting flanges 62 that extend away from one another at the free ends of the U-shaped holding part 61. A reinforcement 63 extends rearward along both side surfaces of the holding part 61, and a cap-mounting part 64 projects out in the width direction of the housing 20 from one of the side surfaces of the holding part 61. The cap 80 can be mounted on the cap-mounting part 64 when the connectors are fit together.

The holding part 61 has two opposed sandwiching walls 65 and a connecting wall 66 that extends between the bottom ends of the sandwiching walls 65. Each sandwiching wall 65 can be opened elastically by flexing substantially about the connection to the connection wall 66. The housing 20 can be inserted into the holding part 61 from above so that the sandwiching walls 65 of the holding part 61 closely contact the wider surfaces of the thick part 23. Mounting holes 67 are formed in the mounting flanges 62 to allow the bracket 60 to be mounted on the body of the vehicle. One of the mounting holes 67 is circular. However, the other mounting hole 67 is elliptic and has a long axis that extends parallel to a line connecting the two mounting flanges 62.

A groove 68 extends around the U-shaped holding part 61 substantially from one mounting flange 62 to the other and is formed so that a concave surface of the groove 68 faces into the U-shaped holding part 61. Additionally, the groove 68 is substantially centrally between the opposite front and rear edges of the U-shaped holding part 61. The width of the groove 68 in a front to rear direction on the U-shaped holding part 61 substantially corresponds to the outside dimension defined by the spaced-apart ribs 24 on the thick part 23 of the housing 20. Thus, the ribs 24 can be fit in the groove 68 to prevent the bracket 60 from moving in the longitudinal direction of the housing 20.

The reinforcing part 63 has a pair of L-shaped sandwiching pieces 69 with tips that project towards one another. The tips of the sandwiching pieces 69 are dimensioned and spaced apart an appropriate distance to slide into portions of the peripheral groove 28 formed on the wider surfaces of the medium part 25 of the housing 20.

In this embodiment, three female terminal fittings 41 and one male terminal fitting 42 are arranged at regular intervals in the width direction of the housing 20. At least parts of the terminal fittings 41, 42 are insert molded for tight accommodation in the housing 20. Thus, parts of each terminal 41, 42 are surrounded by a unitary matrix of the synthetic resin that forms the housing 20.

The female terminal fittings 41 have the same configuration and size. Each female terminal fitting 41 is shaped by punching a metal plate into a predetermined configuration and then bending the punched plate. More specifically, the female terminal fitting 41 has a box-shaped body 43 that is long and narrow in the longitudinal direction of the housing 20 and a barrel 44, fixed to the terminal of an electric wire 70, which is disposed rearward from the body 43. The barrel 44 is crimped into connection with a wire 70. A neck 45 is interposed between the body 43 and the barrel 44 and becomes gradually narrower towards the barrel 44.

The male terminal fitting of a mating connector enters the body 43 when the connector 10 fits on the mating connector. Contact between the female terminal fitting 41 and the mating male terminal fitting establishes electrical connection. The barrel 44 has two caulking pieces 46 that are caulked to the core wire of the electric wire 70 and wound circumferentially around the electric wire 70.

Like the female terminal fitting 41, the male terminal fitting 42 has a box-shaped body 43 and a barrel 44 is disposed rearward of the body 43. The barrel 44 is fixed to the end of an electric wire 70. As shown in FIG. 1, a front part of the body 43 of the male terminal fitting 42 is exposed to the outside from the front-end surface of the housing 20. However, a rear end portion of the body 43 is disposed in the housing 20. The body 43 of the male terminal fitting 42 fits into a socket of mating connector when the connector 10 fits on the mating connector.

Figure 2:
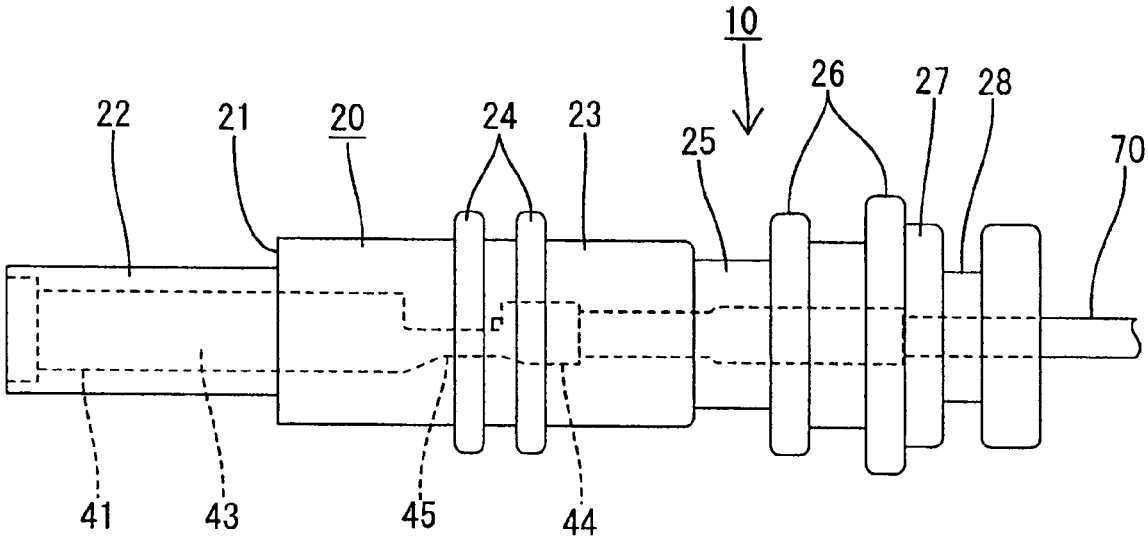
FIG. 2 is a side view showing the connector.

As shown in FIG. 2, the body 43 of the female terminal fitting 41 accommodated in the housing 20 is disposed in both the thin part 22 and the thick part 23. The body 43 is exposed to the outside with the front-end surface thereof slightly rearward from the front-end surface of the housing 20. That is, the length of the body 43 of the female terminal fitting 41 exceeds the length of the body of the terminal fitting currently available. The neck 45 is rearward from the body 43 and is coincident with the region where the rib 24 of the thick part 23 is formed. The barrel 44 is disposed rearward from the neck 45 and is coincident with an approximately central region of the thick part 23 in the longitudinal direction of the thick part 23. The end of the electric wire 70 to which the barrel 44 is to be caulked is disposed in a range from the thick part 23 to the entire region of the medium thick part 25.

The connector is assembled by initially fixing the terminal fittings 41, 42 to the ends of the respective electric wires 70. A resin material then is molded around the periphery of the terminal fittings 41, 42 and around the ends of the electric wires 70. Thus, part of each terminal fitting 41, 42 is surrounded by a unitary matrix of the resin. A heat-shrinkable tube or the like may be mounted over the connection of the terminal fitting 41, 42 to the wire 70 to protect the end of the wire 70 from the molten resin during the molding process. The housing 20 then is juxtaposed to the holding part 61 of the bracket 60, as shown in FIG. 3, and is moved along a direction shown by the arrow of FIG. 3 to fit the housing 20 into the holding part 61 of the bracket 60. The housing 20 is accommodated entirely in the holding part 61 so that upper surface of the housing 20 is flush with the upper surface of the holding part 61 and, the mounting part 62 of the bracket 60 is disposed uppermost. The upper surface of the mounting part 62 then closely contacts a mounting surface of the body of the vehicle to fix the bracket 60 to the body of the vehicle with an unshown fixing tool through the mounting hole 67.

As described above, the body 43 of the box-shaped female terminal fitting 41 is disposed in both the thin part 22 and the thick part 23, and extends across the boundary between the thin part 22 and the thick part 23. Thus, an external force applied to the thin part 22 will not cause the thin part 22 to deform elastically on the step 21 in the width direction of the housing 20. Accordingly, it is possible to prevent the female terminal fitting 41 from being bent.

The thin part 22 is covered with the cap 80 to waterproof the housing 20.

The outer surface of the thick part 23 is covered with the bracket 60. The bracket 60 enables the housing 20 to be mounted efficiently on the body of the vehicle.

The ribs 24 of the thick part 23 fit in the groove 68 of the bracket 60. Thus, the bracket 60 is prevented from moving in the longitudinal direction of the housing 20 and is held securely by the housing 20. The ribs 24 project from around the entire periphery of the outer surface of the thick part 23 to increase the strength of the housing 20.

The invention is not limited to the embodiment described above with reference to the drawings. For example, the following embodiments are included in the technical scope of the present invention. Further, various modifications of the embodiments can be made without departing from the spirit and scope of the present invention.

The terminal fitting is accommodated in the housing by molding in the above-described embodiment. However, the terminal fitting may be inserted into a cavity formed inside the housing.

In the above-described embodiment, several female terminal fittings are disposed in both the thin part and the thick part. However, only one female terminal fittings may be disposed in both the thin part and the thick part.

The body of the female terminal fitting is disposed in both the thin part and the thick part in the above-described embodiment. However, the body of a male terminal fitting may be disposed in both the thin part and the thick part.

What is claimed is:

1. A connector, comprising:

a wide substantially flat housing formed of synthetic resin and having a front end for mating with another connector and a rear end opposite the front end, said housing having a cross-sectionally small part adjacent the front end and a cross-sectionally larger part adjacent to and rearward of the cross-sectionally small part, such that a step is defined between the cross-sectionally small and larger parts of the housing, the step facing towards the front end of the housing; at least one rib projecting out from the cross-sectionally larger part of the housing and extending entirely around an outer periphery of the cross-sectionally larger part;

a bracket mounted on the cross-sectionally larger part and having a groove engaging the at least one rib to prevent the bracket from moving between the front and rear ends of the housing; and a plurality of terminal fittings accommodated substantially side by side in said housing, each of said terminal fittings having opposite front and rear ends, a barrel at the rear end of the terminal fitting and fixed to an end of an electric wire so that the wire extends from the rear end of the housing, and a box-shaped body disposed forward from the barrel and between the barrel and the front end of the housing, the body being configured to be connected with a terminal fitting of a mating connector, the body of each of said terminal fittings being disposed partly in the cross-sectionally small part and partly in the cross-sectionally larger part.

2. The connector of claim 1, further comprising a rubber cap removably mounted over said cross-sectionally small part for waterproofing the connector.

3. The connector of claim 1, wherein the wide substantially flat housing has opposite wide outer surfaces and opposite narrow outer surfaces extending between the wide outer surfaces, the bracket sandwiching the wide outer surfaces and being opposed to one of the narrow outer surfaces, the bracket further having at least one mounting flange for mounting the connector on a support.

4. The connector of claim 3, wherein each of said terminal fittings has a neck between the body and the barrel, the rib being substantially aligned with the neck of each of said terminal fittings.

5. The connector of claim 3, wherein the bracket has a substantially U-shaped holding part for engaging the wide outer surfaces of the cross-sectionally larger part of the housing and one of the narrow outer surfaces of the cross-sectionally larger part of the housing.

6. The connector of claim 5, wherein the bracket further includes reinforcements projecting rearward from the U-shaped holding part and engaging portions of the housing in proximity to the rear end of the housing.

7. The connector of claim 1, wherein the terminal fittings define inserts about which the housing is molded, so that the housing defines a unitary matrix of synthetic resin surrounding and supporting substantially all of each of said terminal fittings rearward of the front end and portions of the wires to which the terminals are fixed.

8. The connector of claim 7, wherein at least one of the terminal fittings is a female terminal fitting, the body of the female terminal fitting being rearward of the front end of the housing, at least one of the terminal fittings being a male terminal fitting, a front end of the body of the male terminal fitting projecting beyond the housing.

9. A connector, comprising:

a housing formed unitarily of synthetic resin and having opposite front and rear ends, said housing having opposite wide outer surfaces and opposite narrow outer surfaces extending between the wide outer surfaces, a cross-sectionally small part adjacent the front end and a cross-sectionally larger part adjacent to and rearward of the cross-sectionally small part, a rib extending around the cross-sectionally larger part;

a plurality of terminal fittings defining substantially side by side inserts about which the housing is molded, so that the resin of said housing defines a unitary matrix surrounding and supporting parts of each said terminal fittings, each of said terminal fittings having a barrel fixed to an end of an electric wire and disposed rearward of the cross-sectionally small part of the housing, a neck forward of the barrel and a box-shaped body forward of the neck and configured for connection with a terminal fitting of a mating connector, the body of each of said terminal fittings being disposed partly in the cross-sectionally small part and partly in the cross-sectionally larger part, the neck being substantially aligned with the rib; and a bracket having a U-shaped holding part engaging the wide outer surfaces and one of the narrow outer surfaces on the cross-sectional larger part of the housing, the holding part having a groove engaging the rib, the bracket further having at least one mounting flange for mounting the connector on a support, whereby the cross-sectionally larger part, the rib and the holding part of the bracket support the necks of the terminal fittings and the box-shaped bodies of the terminal fittings support the cross-sectionally smaller parts of the housing.

* * * * *